US009021825B2

(12) United States Patent
Hewitt et al.

(10) Patent No.: US 9,021,825 B2
(45) Date of Patent: May 5, 2015

(54) APPARATUS FOR MAINTAINING THE TEMPERATURE OF A FLUID

(75) Inventors: Benjamin R. Hewitt, Orlando, FL (US); Roy Paul Prosise, Cedar Park, TX (US)

(73) Assignee: Hewy Wine Chillers, LLC, Orlando, FL (US)

( * ) Notice: Subject to any disclaimer, the term of this patent is extended or adjusted under 35 U.S.C. 154(b) by 311 days.

(21) Appl. No.: 13/449,685

(22) Filed: Apr. 18, 2012

(65) Prior Publication Data

US 2012/0266625 A1 Oct. 25, 2012

Related U.S. Application Data

(60) Provisional application No. 61/477,728, filed on Apr. 21, 2011.

(51) Int. Cl.
*F25D 3/08* (2006.01)
*F25D 31/00* (2006.01)

(52) U.S. Cl.
CPC ..... *F25D 3/08* (2013.01); *F25D 2303/0842* (2013.01); *F25D 2331/803* (2013.01); *F25D 2500/02* (2013.01)

(58) Field of Classification Search
CPC ..... F25D 3/08; F25D 31/002; F25D 31/003; F25D 31/007; F25D 31/008; F25D 3/06; F25D 2303/082; F25D 2303/0822; F25D 2303/08221; F25D 2303/08222; F25D 2303/08223; F25D 2303/0842; F25D 2303/0846; F25D 2331/803; F25D 2331/81; A47G 19/2288
USPC ..... 62/293, 371, 529, 530, 457.3, 372, 62/457.4, 457.8; 600/38; D9/439
See application file for complete search history.

(56) References Cited

U.S. PATENT DOCUMENTS

| | | | | | |
|---|---|---|---|---|---|
| 298,694 | A | * | 5/1884 | Jewett | 220/521 |
| D30,832 | S | | 5/1899 | Lowrey | |
| D30,833 | S | | 5/1899 | Lowrey | |
| 1,030,325 | A | * | 6/1912 | Peoples et al. | 220/521 |
| 2,164,314 | A | * | 7/1939 | Edwards | 222/479 |
| D122,941 | S | * | 10/1940 | Grunberg | D9/439 |
| D135,105 | S | | 2/1943 | Moran | |
| 2,734,358 | A | * | 2/1956 | Himmelfarb | 220/23.87 |

(Continued)

FOREIGN PATENT DOCUMENTS

| | | | |
|---|---|---|---|
| CN | 201264748 | Y | 7/2009 |
| DE | 10037433 | A1 * | 8/2001 |

(Continued)

OTHER PUBLICATIONS

Propylene Glycol based heat-transfer Fluids, The Engineering Toolbox, www.engineeringtoolbox.com, Sep. 15, 2010, accessed through archive.org/web Apr. 16, 2014.*

(Continued)

*Primary Examiner* — Tho V Duong
*Assistant Examiner* — Aaron Isenstadt
(74) *Attorney, Agent, or Firm* — Abel Law Group, LLP

(57) ABSTRACT

An apparatus for maintaining the temperature of a fluid in a container includes a body having a cavity and a seal assembly adapted to engage and temporarily seal the container; a second fluid located and sealed in the cavity and having a freezing point below 0° C.; and the body and the seal assembly have no apertures through which the fluid or the second fluid flows.

17 Claims, 9 Drawing Sheets

(56) References Cited

U.S. PATENT DOCUMENTS

| | | | | |
|---|---|---|---|---|
| 2,746,265 | A | 5/1956 | Mills | |
| 2,749,719 | A | 6/1956 | Copeman | |
| 3,059,452 | A * | 10/1962 | Griffin | 62/457.2 |
| 3,161,031 | A * | 12/1964 | Flannery | 62/457.4 |
| 3,320,767 | A | 5/1967 | Whalen | |
| 4,402,195 | A * | 9/1983 | Campbell | 62/457.3 |
| 4,531,383 | A † | 7/1985 | Zimmermann | |
| 4,702,396 | A | 10/1987 | Gwiazda | |
| 4,735,063 | A | 4/1988 | Brown | |
| 4,981,022 | A * | 1/1991 | Snyder | 62/457.3 |
| D318,009 | S | 7/1991 | Litton | |
| 5,129,238 | A | 7/1992 | Schwartz et al. | |
| 5,456,090 | A | 10/1995 | McCoy | |
| 5,467,877 | A | 11/1995 | Smith | |
| 5,472,274 | A | 12/1995 | Baillie | |
| 5,502,981 | A * | 4/1996 | Sullivan | 62/372 |
| D371,269 | S | 7/1996 | Shattuck et al. | |
| D380,677 | S | 7/1997 | Joergensen | |
| 5,651,254 | A | 7/1997 | Berry | |
| 5,732,567 | A † | 3/1998 | Anderson | |
| D404,647 | S | 1/1999 | Federighi | |
| 5,881,868 | A | 3/1999 | Soyak et al. | |
| 6,103,280 | A | 8/2000 | Molzahn et al. | |
| 6,196,017 | B1 | 3/2001 | Chapman | |
| 6,324,864 | B1 * | 12/2001 | Stewart et al. | 62/457.3 |
| D459,227 | S | 6/2002 | Liebmann, Jr. | |
| 6,494,056 | B1 | 12/2002 | Roth et al. | |
| 6,584,800 | B1 | 7/2003 | Roth et al. | |
| 6,622,516 | B1 | 9/2003 | Horen | |
| 6,658,859 | B2 | 12/2003 | Phelps et al. | |
| 6,751,982 | B2 | 6/2004 | Horen | |
| 6,889,945 | B2 | 5/2005 | McCall | |
| 7,069,739 | B2 | 7/2006 | Porter | |
| 7,082,784 | B2 | 8/2006 | Roth et al. | |
| 7,185,782 | B2 | 3/2007 | Vilchez, Jr. et al. | |
| 7,299,936 | B2 | 11/2007 | Singh et al. | |
| D559,870 | S * | 1/2008 | Conlon et al. | D15/90 |
| D602,355 | S | 10/2009 | Waaland | |
| 7,614,512 | B2 | 11/2009 | Nader | |
| 7,614,513 | B2 † | 11/2009 | Anderson | |
| 7,802,446 | B2 † | 9/2010 | Overgaard | |
| 7,810,348 | B2 | 10/2010 | Shewchuk | |
| D632,571 | S | 2/2011 | Blythe | |
| D634,158 | S | 3/2011 | Roth et al. | |
| 7,997,099 | B2 | 8/2011 | Roth et al. | |
| 8,051,674 | B2 | 11/2011 | Roth et al. | |
| 8,061,158 | B2 | 11/2011 | Roth et al. | |
| 8,069,860 | B2 | 12/2011 | Soyak et al. | |
| D660,077 | S | 5/2012 | Burns | |
| 8,172,454 | B2 † | 5/2012 | Choi | |
| 2002/0005044 | A1 | 1/2002 | Mahajan | |
| 2003/0196448 | A1 | 10/2003 | Roth et al. | |
| 2004/0123620 | A1 | 7/2004 | Porter | |
| 2006/0010903 | A1 | 1/2006 | Porter | |
| 2006/0162374 | A1 | 7/2006 | Ganser | |
| 2007/0147469 | A1 | 6/2007 | Harris | |
| 2008/0290062 | A1 | 11/2008 | Luzaich et al. | |
| 2010/0202244 | A1 * | 8/2010 | Choi | 366/144 |
| 2011/0108506 | A1 | 5/2011 | Lindhorst-Ko | |
| 2011/0114218 | A1 | 5/2011 | Overgaard | |

FOREIGN PATENT DOCUMENTS

| | | | |
|---|---|---|---|
| EP | 1450118 | A2 | 8/2004 |
| EP | 1985951 | A1 | 10/2008 |
| FR | 2736894 | A1 | 1/1997 |
| FR | 2805337 | A1 | 8/2001 |
| GB | 2340591 | A | 2/2000 |
| JP | 2001048244 | A * | 2/2001 |
| JP | 2001048244 | A1 | 2/2001 |

OTHER PUBLICATIONS

Matsuri Sake Set by Roost, Oprah.com.

PCT/US2012/034016 International Search Report mailed Nov. 29, 2012.

PCT/US2013/044958: International Search Report mailed Sep. 2, 2013.

PCT/US2014/010069; International Search Report mailed May 7, 2014.

C.B. Peoples & A.E. Yelton, Milk Can, 3 of 3, Jun. 25, 1912, USPTO, Washington D.C.†

I.G. Royall, Jr., Rubber Stopper, 3 of 3, Jul. 28, 1950, USPTO, Washington D.C.†

Chef Todd English Will Launch the Todd English Collection(TM) on HSN and HSN.Com on Nov. 7 and 8, Nov. 3, 2005, PR Newswire LLC, http://www.thefreelibrary.com/Chef+Todd+English+Will+Launch+The+Todd+English+Collection(TM)+on+HSN . . . -a0138256281.†

Wine Sceptre—YouTube, 2, Mar. 18, 2010, YouTube, http://www.youtube.com/watch?v=Qt58q8jdp08.†

Phillip Fought, Corkcicle Wine Chiller, 5 of 5, Aug. 17, 2012, Phillip Kitchenboy Fought, http://kitchenboy.net/blog/corkcicle-wine-chiller-2/.†

* cited by examiner
† cited by third party

APPARATUS FOR MAINTAINING THE TEMPERATURE OF A FLUID

This application claims priority to and the benefit of U.S. Provisional Patent Application No. 61/477,728, which was filed on Apr. 21, 2011, and is incorporated herein by reference in its entirety.

BACKGROUND OF THE INVENTION

1. Field of the Disclosure

The present invention relates in general to regulating the temperature of a fluid and, in particular, to an apparatus for regulating the temperature of wine in a bottle.

2. Description of the Related Art

The temperature at which wine is served is important to appreciate its special qualities and flavors. There are various tables of authorities that show the ideal temperature ranges for each type of wine or vintage. The temperature ranges vary greatly according to the type of wine. The widest range exists between the desired temperatures associated with red wines versus that of white wines.

There are several factors that make it challenging to maintain the ideal temperature that allows a wine to reveal all of its qualities. One factor concerns the conditions in which the bottles are kept after they are opened. This can lead to a wine temperature that is either too high or too low after the bottle is selected, opened and served. It is difficult to keep wine bottles within satisfactory temperature conditions, as they will more often than not become too warm when left on a table at room temperature, or become too cold if put on ice. Once removed from a proper cooling environment, keeping a chilled wine at a temperature below ambient temperature is particularly difficult.

There also is some risk of the wine losing its flavors and taste by bringing about a decrease in temperature that occurs too quickly. For example, use of a wine ice bucket or freezer may cause this destructive effect on the qualities of wine. In some businesses, such as restaurants and catering, this process needs to be done quickly and cannot be avoided. It is rarely possible for some wine servers to ask a customer to wait to taste the vintage chosen on a wine list. It is also undesirable to risk being discredited by serving a wine that is at the wrong temperature. It is therefore desirable to facilitate bringing and maintaining wine at an ideal temperature to savor it without necessarily affecting its qualities.

Various solutions have been proposed to maintain the desired wine temperature in conditions that reduce risk to affecting its taste. Again, wine ice buckets are a common choice for this proposition and there are many different types. Other solutions are inserted into a bottle of wine and incorporate pour-through apertures such that their apparatus is not removed from the bottle until it is empty. Moreover, pour-through devices enable ventilation of the beverage which increases its temperature and affects its taste. Thus, improvements in regulating the temperature of wine would be desirable.

SUMMARY

Embodiments of an apparatus for maintaining the temperature of a fluid are disclosed. In some embodiments, an apparatus may be used for maintaining a temperature of a fluid in a container. The apparatus may comprise a body having a cavity and a seal adapted to engage and temporarily seal the container; a second fluid located and sealed in the cavity and having a freezing point of about 0° C. or less; and the body and the seal have no apertures through which the fluid or the second fluid flows.

In other embodiments, the apparatus may be used for maintaining a temperature of wine in a bottle, and comprise a body having an axis, a proximal end, a distal end, a cavity inside the body that is open on the proximal end, closed on the distal end, and an elongated shape in an axial direction; a fluid located in the cavity and having a freezing point below 0° C.; and a seal assembly mounted to the proximal end of the body to seal the fluid inside the cavity, and the seal assembly is adapted to slidingly and temporarily seal the bottle of wine.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figures 1A, 1B, 1C, 1D:
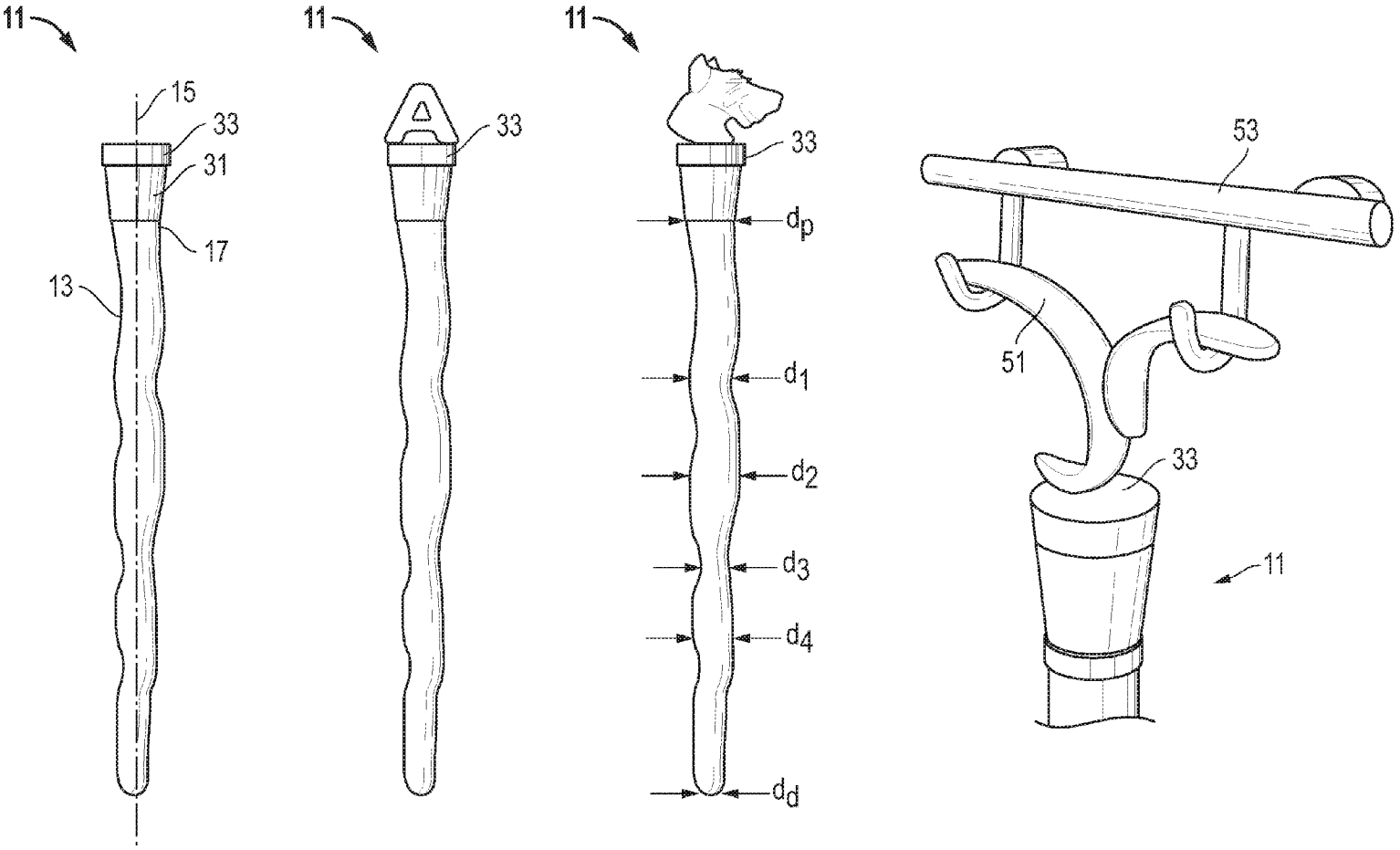
FIGS. 1A-D are front views of various embodiments of an apparatus for maintaining the temperature of a fluid.
Figure 2:
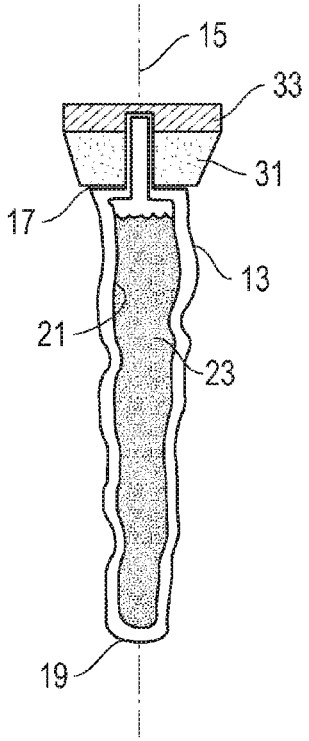
FIG. 2 is a sectional front view of an embodiment of the apparatus.

Embodiments of an apparatus for maintaining the temperature of a fluid are disclosed. As shown in FIGS. 1A and 2, the apparatus 11 may comprise a body 13 having a longitudinal axis 15, a proximal end 17, and a distal end 19. A cavity 21 is located inside the body 13. The cavity 21 is open on the proximal end 17, closed on the distal end 19, and has an elongated, generally tapered shape along an axial length of the body 13. A fluid 23 is located in the cavity 21 and has a freezing point of about 0° C. or less. For example, the freezing point of the fluid 23 may be in a range of −1° C. to −30° C. When apparatus 11 is chilled or frozen, fluid 23 helps maintain or regulate a temperature of a liquid, such as wine 25 in a bottle 27. See, e.g., FIG. 4.

Embodiments of the fluid 23 may comprise a liquid or gel having a high potential heat value and a high specific heat capacity. The fluid has good water retention properties and is reusable. The fluid is non-toxic, non-polluting and a nonirritant to human contact. The fluid may comprise water and additives that cause the water to remain a thick gel throughout use, instead of transitioning between a solid and a free-flowing liquid like ordinary water. Such a gel may be formed from non-toxic materials that will not liquefy, and therefore will not spill easily or cause contamination if the container breaks. For example, the gel may be made by adding hydroxyethyl cellulose (e.g., cellusize) or vinyl-coated silica gel to water.

In some embodiments a seal or seal assembly, such as a stopper (e.g., gasket, -ring, plunger, cork, etc.) 31, may be mounted to the proximal end 17 of the body 13 and may be adapted to slidingly and temporarily engage and seal the bottle 27 of wine 25. This design permits fluid to flow from the bottle with the apparatus only partially removed from the bottle (with most of the body still located inside of the bottle in contact with the wine). The stopper may comprise natural or synthetic materials such as those known in the art. For example, a synthetic cork may be formed from a high quality, food grade thermoplastic elastomer, a wood material bonded by a bond material or resin, etc. The seal or stopper also provides structural support during the freezing and thawing cycles experienced during operational use, which better accommodates for expansion and contraction of materials to help prevent layered or laminated designs from failing.

In other examples, the seal is located completely inside the body and the proximal end of the body is tapered in such a way as to loosely, slidingly and temporarily engage and/or seal the bottle of wine.

A plug or cap 33 may be mounted to the proximal end 17 of the body 13 to seal the fluid 23 inside the cavity 21. In an example, both the stopper 31 and the cap 33 are directly mounted to the proximal end 17 of the body 13, and the cap 33 permanently seals the fluid 23 inside the cavity 21. Cap 33 also may be used to retain the stopper 31 on the proximal end 17 of the body 13, such that the body 13, stopper 31 and cap 33 form a unitary structure. In some examples, the body 13 may be formed from a plastic material, such as a translucent or transparent ethylene-based copolymer, polymeric blends of ethylene-methacrylic acid copolymers and polyethylene, etc. In other embodiments the body may be opaque and may comprise other materials such as metallic materials (e.g., copper, stainless steel, etc.).

In some embodiments, the apparatus 11 may comprise only four components: the body 13, the fluid 23, the stopper 31 and a plug for the body, such as a cap 33. These components may be joined by conventional techniques, such as spin or ultrasonic welding and permanently joined to each other. Adhesives also may be used to join the components. In other embodiments, the apparatus comprises only three components: the body 13, the fluid 23 and a seal/stopper. For example, in such embodiments the body may be sealed by the seal to retain the fluid, or the neck may be bonded, crimped, welded, etc. to permanently enclose the fluid, and the seal attached to provide a sliding interface surface for temporarily closing a container of fluid (e.g., bottle of wine).

In other embodiments, the body 13 has only one cavity 21, only one fluid 23, and is non-cylindrical, but somewhat conically tapered. The body 13 may have only one opening 35 (FIG. 3) on the proximal end 17 that is sealed and permanently closed. The body 13, stopper 31 and cap 33 have no apertures through which any other fluid flows. Both the exterior surface of the body 13 and the cavity 21 may be generally conically tapered along substantially their entire axial lengths. Tapering of the cavity 21 facilitates progressive freezing of the fluid from the distal end 19 toward the proximal end 17, and thereby the desired expansion of the fluid 23 into the tube 37 as the fluid freezes solid. Such progressive freezing helps maintain the integrity of the body, even after numerous freezing/thawing cycles and uses, without leakage or rupture of the plastic body.

Figure 3:
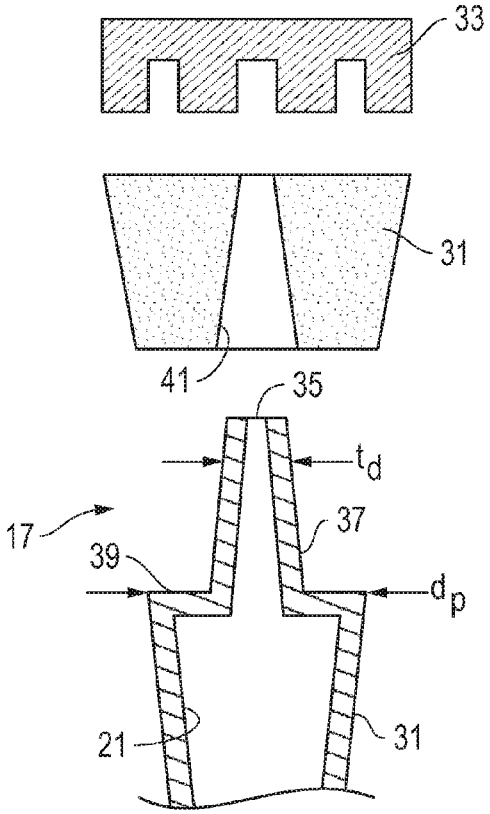
FIG. 3 is an enlarged sectional front view of an upper portion of the apparatus.

As best shown in FIGS. 2 and 3, the proximal end 17 of the body 13 may comprise a tube 37 extending axially from the body 13. The tube 37 may have a tube diameter ($d_t$) that is smaller than a diameter ($d_p$) of the body. The stopper 31 is mounted to the tube 37, and may mount to and seal the opening 35 on the end of the tube 37. A shoulder 39 may be formed at an interface of the tube 37 and body 31. The tube 37 may frustoconically taper in the axial direction, and may have a largest diameter at the shoulder 39. The stopper 31 may seat on the shoulder 39 and have a through-hole 41 for receiving the tube 37. The through hole 41 is complementary in shape to the tube 37. The stopper 31 may be synthetic and frustoconically tapered on both its exterior and interior and interior surfaces.

Figure 6A:
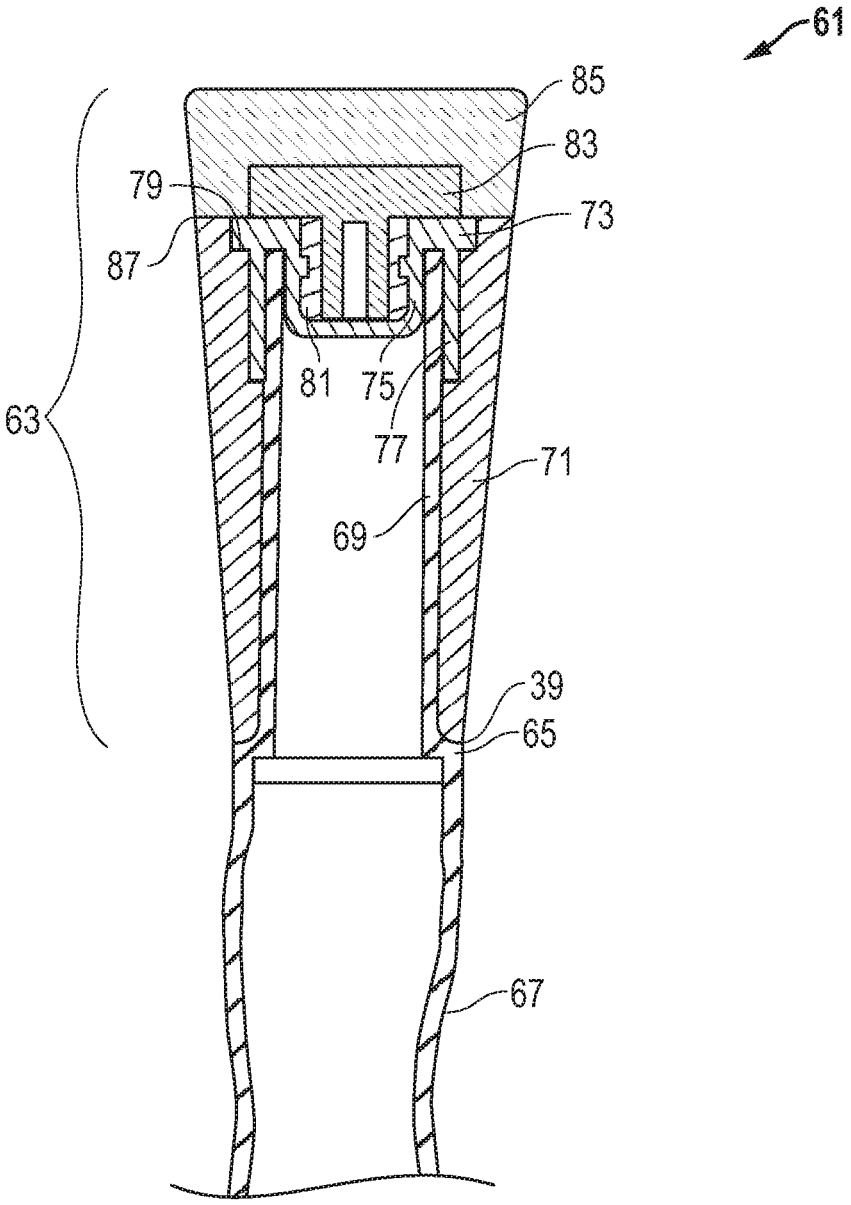
FIGS. 6A and 6B are sectional side views of upper portions of embodiments of FIG. 5, after assembly, showing the cap installed in FIG. 6A, and without a cap in FIG. 6B.

In some embodiments, the shoulder 39 is radiused (FIGS. 6A and 6B) to provide protection from shear while acting as a stop for the stopper during assembly. The radius likewise can form a radiused neck for tube 69 as shown. The radiused neck helps to prevent breaking shear and stress for the expansion of freezing fluid into tube 69. Likewise the radiused neck facilitates material flow during the manufacturing thereof.

In some embodiments, the volume of fluid 23 contained within chamber 21 is sufficient so as to not be visible from an exterior of body 13 when held or stored upright with the stopper 31 at the top. In contrast, the example of FIG. 2 depicts the volume of fluid 23 as being visible from the exterior of body 13. However, in this alternate embodiment, the volume of fluid 23 may be sufficient to fill all of cavity 21 and extend at least partially into tube 37 (see FIG. 3), even in a liquid, non-frozen state. Upon freezing, fluid 23 further expands in volume and extends even further into tube 37. In this way, tube 37 acts as a fluid expansion reservoir when fluid 23 is frozen and expands in volume.

In some embodiments, the body 13 is shaped in the form of an icicle (FIG. 1C), and varies in axial sectional shape along an entire axial length thereof. The body 13 may have an exterior surface that undulates axially, radially and/or circumferentially. As a result, some examples of the body have an axial cross-sectional shape that varies continuously from the proximal end 17 to the distal end 19. Such a configuration mimics naturally formed icicles. Such designs also increase the surface area of the body, thereby increasing its wine temperature performance. In other versions, the body has only a slight overall taper (e.g., like a carrot), rather than the icicle form. In still other versions, the body may be tapered with facets to appear crystalline in form, or may be cylindrical in shape.

For example, the body 13 may be provided with a proximal diameter at the proximal end ($d_p$) that defines a maximum diameter of the body, a distal diameter at the distal end ($d_d$) that defines a minimum diameter of the body, a first intermediate diameter ($d_1$) located between the proximal and distal ends that is smaller than the proximal diameter, and a second intermediate diameter ($d_2$) located between the first intermediate diameter and the distal end that is larger than the first intermediate diameter. This pattern may be repeated. For example, a third intermediate diameter ($d_3$) may be smaller than $d_2$ but located between $d_2$ and $d_d$. A fourth intermediate diameter ($d_4$) may be larger than $d_3$, but located between $d_3$ and $d_d$. The interior surface of the cavity may mimic the profile or contour of the exterior of the body, such that the interior and exterior surfaces of the body are complementary in shape.

For example, the apparatus may have a maximum outer diameter of about 16 mm, the body may have a wall thickness of about 0.5 to 1 mm, and the apparatus may have an overall length of about 280 mm. These dimensions may be varied to accommodate containers or bottles having different sizes.

In still other embodiments (see, e.g., FIGS. 1B, 1C, 1D and 4), the cap 33 may comprise decorative or ornamental features. For example, a three-dimensional shape, sculpture or design may extend or protrude from the cap. Such features have the utility of further enabling the user to more easily grip and articulate the apparatus. Moreover, the embodiment of FIG. 1D provides a utilitarian handle 51 that may be hung on a bracket 53 when apparatus 11 is not in use. In some versions, the cap 33 and/or stopper 31 are provided with a threaded insert (e.g., female threads) that receive male threads extending from handle 51.

Figure 4:
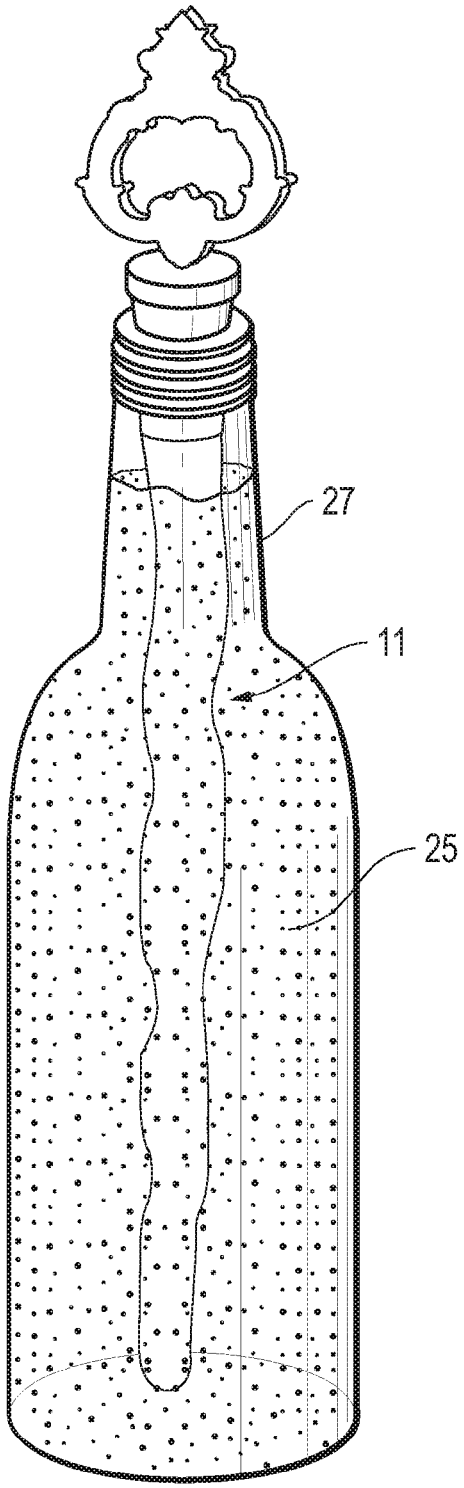
FIG. 4 is an isometric view of an embodiment of the apparatus in operation.

In operation, apparatus 11 may be chilled or frozen by placing it in a freezer. When a user wishes to maintain or regulate the temperature of a fluid in a container, the apparatus 11 may be removed from the freezer and placed in the container such that body 13 is in contact with the fluid. For example, as shown in FIG. 4, the apparatus 11 may be inserted into a bottle 27 of wine 25 to maintain the wine 25 at a proper serving temperature for a longer period of time. Any of the embodiments described herein may be used in a similar manner. The apparatus 11 may form a sliding, temporary seal on the bottle 27. Other applications include uses that do not involve beverages, such as commercial or laboratory cooling or temperature regulation of fluids in containers, wherein the stopper may not necessarily be required to slidingly engage and seal the opening of the container. For example, some containers have top openings that are much larger in diameter than the diameter of the stopper.

In other embodiments, the apparatus for maintaining a temperature of a fluid in a container comprises a body having an internal cavity and a seal adapted to slidingly engage and temporarily seal the container; a second fluid located and sealed in the internal cavity and having a freezing point below 0° C.; and the body has no apertures through which the fluid or the second fluid flows. The body may have a shape that is non-cylindrical.

In another embodiment, the apparatus for maintaining a temperature of wine in a bottle comprises a body having an axis, a proximal end, a distal end, a cavity inside the body that is open on the proximal end, closed on the distal end, and an elongated, generally tapered shape along an entire axial length of the body; a fluid located in the cavity and having a freezing point below 0° C.; a stopper mounted to the proximal end of the body and adapted to seal the bottle of wine; and a cap mounted to the proximal end of the body to seal the fluid inside the cavity, and retain the stopper on the proximal end of the body, such that the body, stopper and cap form a unitary structure.

The apparatus may comprise only three or four components. Other embodiments are adhesively bonded. The body may have only one opening on the proximal end that is sealed, and the stopper and cap have no apertures through which any other fluid flows. The body may have only one cavity, only one fluid, and is conically tapered. The body, stopper and cap may be welded and permanently joined to each other.

Figure 7A:
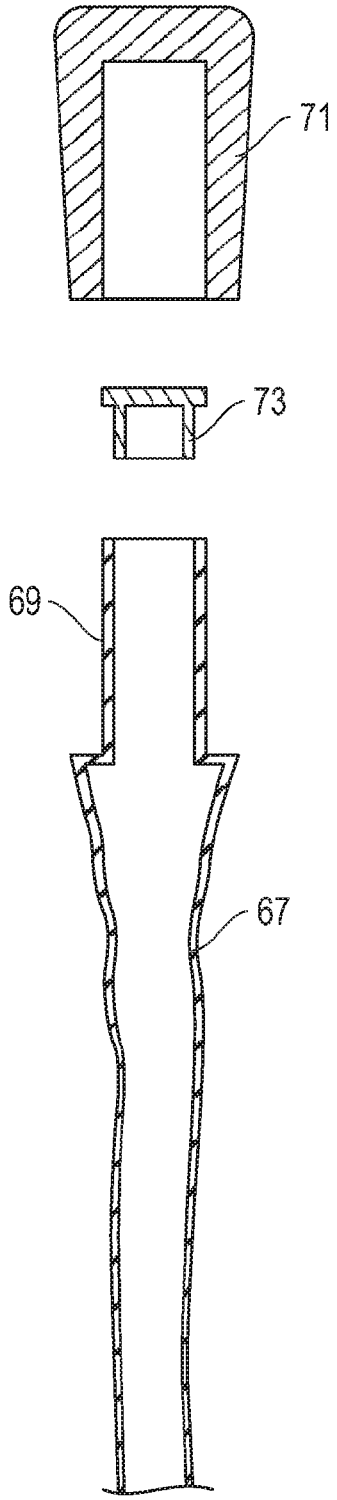
FIGS. 7A and 7B are exploded and assembled sectional side view of another embodiment of the apparatus.
Figure 7B:
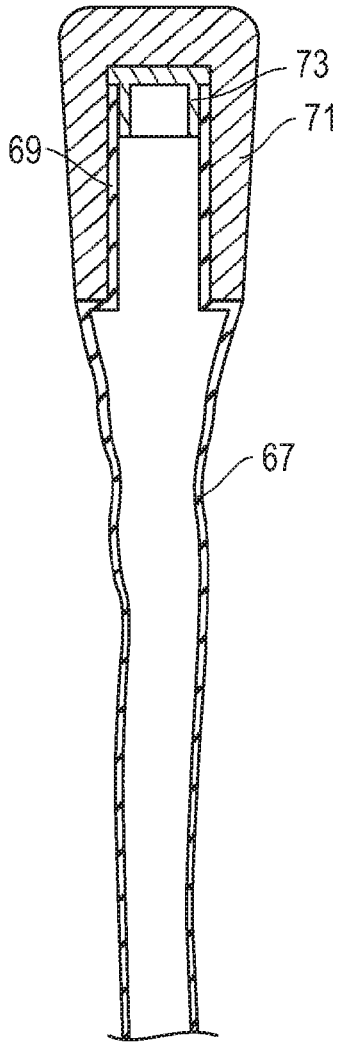
Figure 8A:
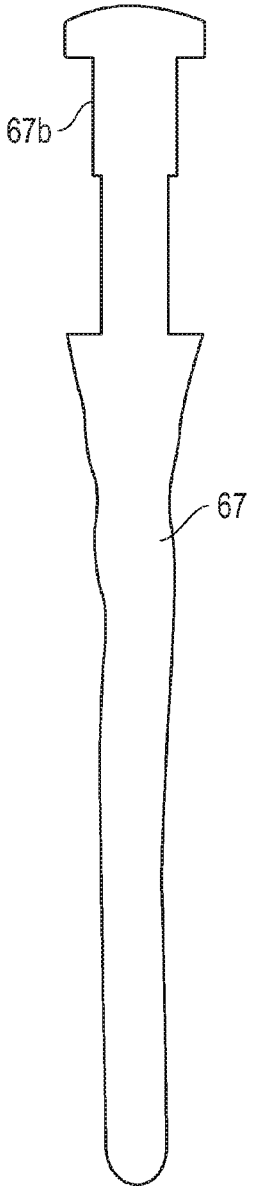
FIGS. 8A-8C and 9A-9C are sequential assembly sectional side views of additional embodiments of the apparatus.
Figure 8B:
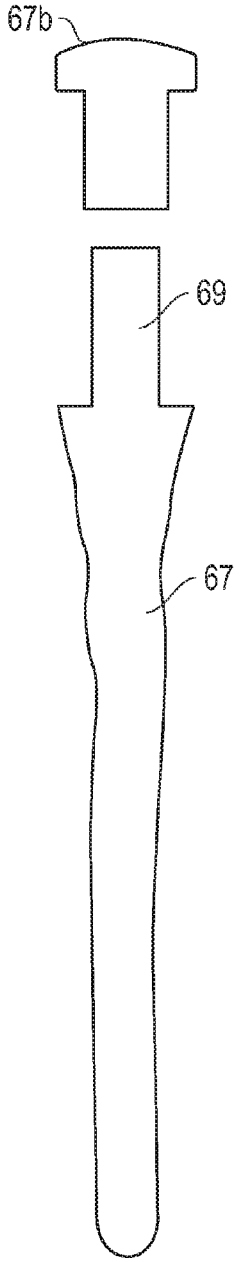
Figure 8C:
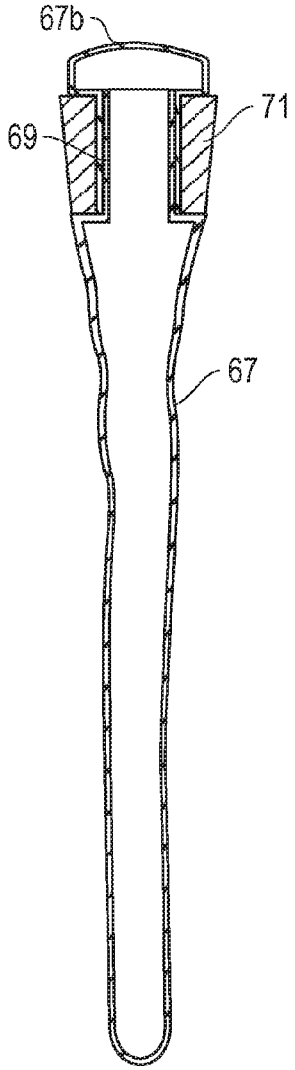

For example, FIGS. 7A and 7B depict another embodiment having a simplified design of only a body 67, the fluid, a plug 73 and a stopper 71, which may be assembled in a manner similar to the other embodiments described herein. In another example, FIGS. 8A-8C depicted molded body 67 wherein the 'cap' 67*b* is molded with the body 67 from the same material. As shown in FIG. 8B, the cap 67*b* is hollow like the body and cut from the body. In FIG. 8C, a tube extending from the cap 67*b* is either forced into the tube 69 on the body 67 or outside around the tube 69, with stopper 71 secured therebetween after the assembly is permanently fastened together as described elsewhere herein to retain the fluid.

Figure 9A:
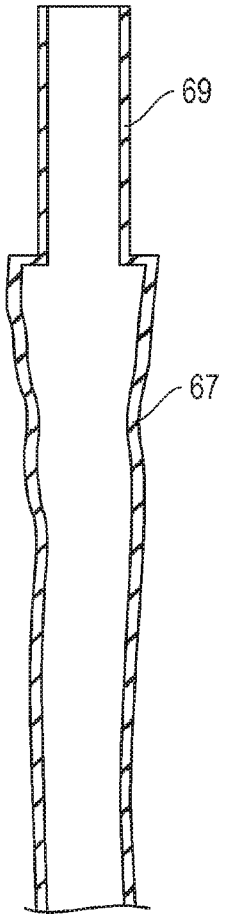
Figure 9B:
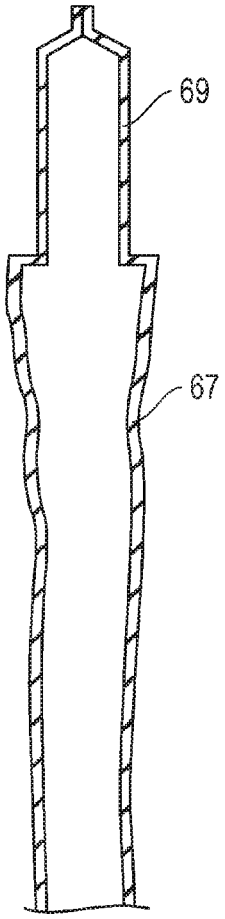
Figure 9C:
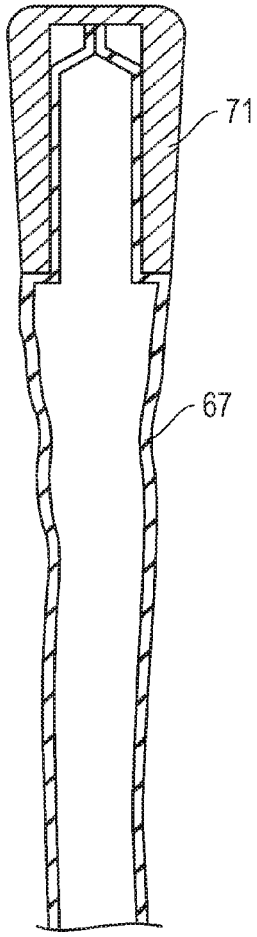

In still other versions (FIGS. 9A-9C), the plug is optional and is not required such that as few as three components (e.g., the body, the fluid and the stopper) are the only components required to complete the apparatus. For example, the tube 69 on the end of the body 67 may be squeezed, pinched, heat staked, sonic welded, etc. (FIG. 9B), to contain the fluid, and the stopper 71 would then be attached to the sealed tube 69.

The proximal end of the body may comprise a tube extending axially from the body, the tube has a tube diameter that is smaller than a diameter of the body, the stopper is mounted to the tube, and the cap is mounted to and seals an opening on an end of the tube. A shoulder may be formed at an interface of the tube and the body, the tube frustoconically tapers axially, having a largest diameter at the shoulder. The stopper may seat on the shoulder and have a through hole for receiving the tube, and the through hole is complementary in shape to the tube.

Optionally, the body and cap may be formed from an ethylene-based copolymer, and the stopper may be synthetic and frustoconically tapered. The freezing point of the fluid may be in a range of −1° C. to −30° C. The body may vary in axial sectional shape along an entire axial length thereof. The body may have an exterior surface that undulates. The body may have a proximal diameter at the proximal end ($d_p$) that defines a maximum diameter of the body, a distal diameter at the distal end ($d_d$) that defines a minimum diameter of the body, a first intermediate diameter ($d_1$) located between the proximal and distal ends that is smaller than the proximal diameter, and a second intermediate diameter ($d_2$) located between the first intermediate diameter and the distal end that is larger than the first intermediate diameter.

The stopper may be adapted to slidingly and temporarily engage the bottle of wine. Both the stopper and the cap may be directly mounted to the proximal end of the body, and the cap permanently seals the fluid inside the cavity.

In still another embodiment, the apparatus for maintaining a temperature of wine in a bottle may comprise a body having an axis, a proximal end, a distal end, a cavity inside the body that is open on the proximal end, closed on the distal end; a fluid located in the cavity and having a freezing point below 0° C.; a stopper mounted to the proximal end of the body and adapted to seal the bottle of wine; a cap mounted to the proximal end of the body to seal the fluid inside the cavity, and retain the stopper on the proximal end of the body, such that the body, stopper and cap form a unitary structure; and the body has only one opening on the proximal end that is sealed, and the stopper and cap have no apertures through which any other fluid flows. Still other embodiments may be had as further described herein.

Figure 5:
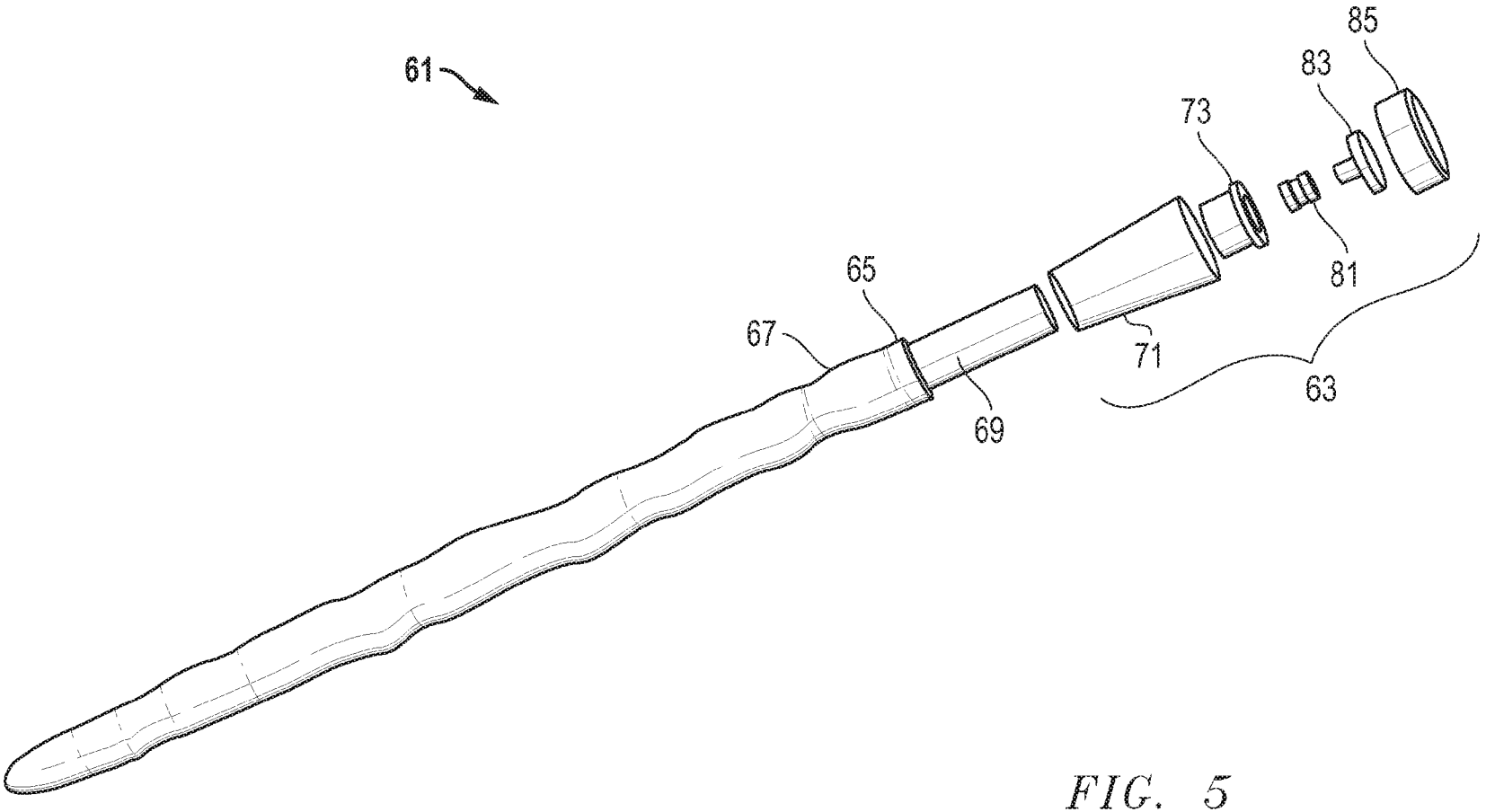
FIG. 5 is an exploded isometric view of another embodiment of the apparatus.

Referring now to FIGS. 5 and 6, still another embodiment of the apparatus 61 is shown with a different seal assembly 63. The seal assembly 63 mounts to the proximal end 65 of the body 67. In some versions, the tube 69 that extends from the proximal end may be cylindrical rather than tapered. The seal member or stopper 71 (e.g., cork), may be mounted to the tube 69 on the proximal end 65 of the body 67 and is adapted to slidingly and temporarily engage and seal a bottle of wine, as described elsewhere herein.

A plug 73 may be mounted to the end of the tube 69 to seal the fluid inside the body 67. The plug 73 may comprise inner and outer cylindrical walls 75, 77 to form an inner seal on tube 69 as well as an outer seal on tube 69, respectively. This 'double seal' allows for the expansion and contraction of materials during the cyclical freezing and thawing, which helps maintain the seal and prevent leakage of the fluid from the body under all operating conditions. The double seal further provides a more complex structure with greater surface area to enhance its sealing ability. The upper end of the plug 73 may have a flange that seats in a small cylindrical recess 79 in the upper end of stopper 71, such that the upper surfaces of stopper 71 and plug 73 are flush when assembled. Plug 73 also may ensure retention of stopper 71 on body 67.

In the embodiment shown, an insert such as a nut 81 may be integrated into a central axial recess in the top of plug 73 as shown. The insert may be threaded or have snaps, a cam, etc., to provide for its retention. For example, the plug 73 may be plastic and molded around a metallic version of nut 81. Nut 81 may be provided with external ribs for better retention and to prevent its rotation during use. The body 67, stopper 71, plug 73 and nut 81 may be permanently joined together as a first unitary sub-structure. In the metal version of the nut, brass or other materials may be used that provide a low thermal expansion with greater rigidity and support to stiffen the assembly.

The interior surface of nut 81 may be with an attachment apparatus to attach to a coupling 83. For example, nut 81 may have threads to threadingly couple with coupling 83. Coupling 83 may be metallic with a head, around which a cap 85 may be formed (e.g., molded). Cap 85 and coupling 83 are joined in such a way so as to prevent the rotation of coupling 83 within cap 85 during use. When joined, the lower surfaces of the cap and the head of coupling 83 may be flush as shown. Cap 85 may comprise the same material as stopper 71 (e.g., cork), a different material or a combination thereof. Thus, cap 85 and coupling 83 together may form a second unitary sub-structure that may be threadingly and releasably coupled to the first unitary sub-structure. The two unitary sub-structures may abut each other in a flush configuration, such that only a small interface or seam 87 appears between them. The threaded configuration also permits the interchangeable usage of other types of "tops" on the apparatus, such as those shown and described for FIG. 1.

Figure 6B:
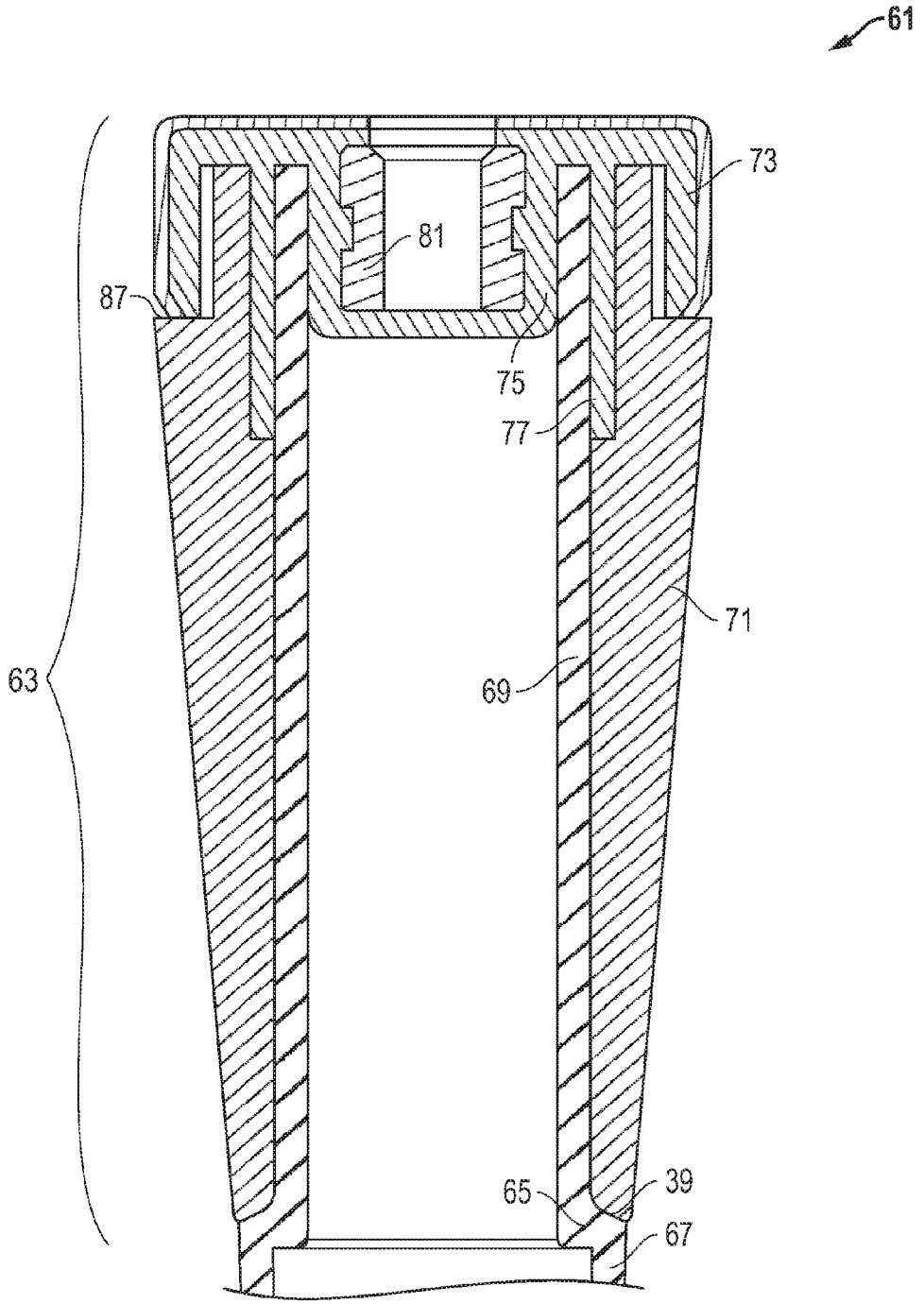

FIG. 6B depicts an example wherein nut 81 is over-molded within a more substantial plug 73. Thus, nut 81 is not flush with the 'top' surface of plug 73 but more securely retained therein because it is axially embedded. The upper end of stopper 71 also is slightly modified to permit plug 73 to overwrap its upper end as shown. The plug 73 is shown with a core material (e.g., plastic) and an external second material (e.g., metallic) around the core material. Plug 73 also may be formed from a single material. A cap and coupling may be joined to this sub-assembly as previously described.

In these embodiments, the completed assembly and final product may comprise the integration of both the first and second unitary sub-structures, to form a single unitary structure. Thus, some embodiments of the apparatus comprise a total of seven components, including the fluid it contains. The numerous features, elements and materials described for the various embodiments disclosed herein may be used in the other embodiments as well.

Examples of other embodiments include an apparatus for maintaining a temperature of a fluid in a container. For example, the body may have a cavity and a seal. The body is adapted to temporarily engage the container and contact the fluid inside the container. A second fluid is located and sealed in the cavity. The second fluid may have a freezing point of about 0° C. or less. The body and the seal have no apertures through which the fluid or the second fluid flows.

In other examples, the apparatus maintains a temperature of wine in a bottle and comprises a body having an axis, a proximal end, a distal end, a cavity inside the body that is open on the proximal end, and an elongated tapered shape in an axial direction. A fluid is located in the cavity and has a freezing point below about 0° C. A seal assembly is mounted to and extends externally from the proximal end of the body to seal the fluid inside the cavity, and the seal assembly is adapted to loosely, slidingly and temporarily engage the bottle of wine.

The body may have only one cavity, and the second fluid is the only material located inside the body other than, perhaps, a portion of the seal. The body is formed from a plastic material and tapered along its substantially entire axial length, and the seal comprises a stopper that is frustoconically tapered and adapted to slidingly and temporarily engage the container. The freezing point of the second fluid is in a range of about −1° C. to about −30° C., and the body is translucent or transparent.

The body varies in axial sectional shape, such that an exterior surface of the body undulates, and the cavity is tapered along its substantially entire axial length. The body may have a proximal diameter ($d_p$) at a proximal end, a distal diameter ($d_d$) at a distal end that defines a minimum diameter of the body, a first intermediate diameter ($d_1$) located axially between the proximal and distal ends that is smaller than $d_p$, and a second intermediate diameter ($d_2$) located axially between $d_1$ and the distal end that is larger than $d_1$.

The seal may comprise a plug mounted to the body, a cap assembly coupled to the plug, and together the body, seal, plug and cap assembly form a unitary structure. The cap assembly may be threadingly and releasably coupled to the plug. The proximal end of the body may comprise a tube extending axially from the body, the tube has a tube diameter that is smaller than a diameter of the body, and the seal is mounted to the tube. The tube may be cylindrical, a shoulder may be formed at an interface of the tube and the body, the seal seats on the shoulder and has a hole for receiving the tube, and the hole is complementary in shape to the tube. The second fluid may have a liquid volume sufficient to fill all of the cavity and extend at least partially into the tube, such that the tube is an expansion reservoir when the second fluid is frozen and expands in volume into the tube.

In still other examples, an apparatus for maintaining a temperature of a fluid inside a container comprises a body having a cavity and a seal including a plug, together the body, seal and plug form a unitary structure, the body is adapted to temporarily contact the fluid inside the container, and the seal is adapted to temporarily engage an opening in the container; a second fluid located and permanently sealed inside the cavity by the plug, the second fluid having a freezing point of about 0° C. or less; and the body and the seal have no apertures through which the fluid or the second fluid flows.

The body may be formed from a plastic material and the body is tapered along a substantially entire axial length thereof, and the seal comprises a stopper that is frustoconically tapered and adapted to slidingly and temporarily engage the opening in the container. The freezing point of the second fluid is in a range of about −1° C. to about −30° C., and the body is translucent or transparent such that the second fluid is visible from an exterior of the body. The body may vary in axial sectional shape, such that an exterior surface of the body undulates, and the cavity is tapered along a substantially entire axial length thereof.

Another apparatus for maintaining a temperature of wine in a bottle may comprise a body having an axis, a proximal end, a distal end, a cavity inside the body that is open on the proximal end, and an elongated tapered shape in an axial direction such that an exterior of the body is tapered axially for a substantially entire axial length thereof; a fluid located in the cavity and having a freezing point below about 0° C.; and a seal assembly mounted to and extending externally from the proximal end of the body to seal the fluid inside the cavity, and the seal assembly is adapted to loosely, slidingly and temporarily engage the bottle of wine. An exterior surface of the body may undulate for the substantially entire axial length thereof.

Other applications for the various embodiments disclosed herein may include usage as a stir stick for beverages, or to accelerate the chilling of wine in a glass.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An apparatus for maintaining a temperature of a fluid inside a container, comprising:

a body having a cavity and a seal mounted to the body, including a plug, the seal comprises a handle for the apparatus when the body is inside the container, together the body, seal and handle form a unitary structure that has a tapered profile along a substantially entire axial length thereof, the body is adapted to temporarily contact the fluid inside the container, and the seal is adapted to directly make contact with the container itself, and temporarily engage an upper interior surface of the container at a top of the container;

a second fluid located and permanently sealed inside the cavity by the plug, the second fluid having a freezing point of 0° C. or less;

the body and the seal have no apertures through which the fluid or the second fluid flows; and the seal comprises a different material than the body, and the body is asymmetric, wherein the body has an axial length substantially similar to that of the container, and the body has a proximal diameter ($d_p$) at a proximal end that defines the greatest diameter of the body, a distal diameter ($d_d$) at a distal end that defines the least diameter of the body, a first intermediate diameter ($d_1$) located axially between the proximal and distal ends that is smaller than $d_p$, and a second intermediate diameter ($d_2$) located axially between $d_1$ and the distal end that is larger than $d_1$.

2. The apparatus of claim 1, wherein the body has only one cavity, and the second fluid is the only material located inside the body, the body contacts the fluid substantially throughout an axial length of the container, and the seal comprises a synthetic stopper.

3. The apparatus of claim 1, wherein the body is formed from a plastic material, and the seal comprises a stopper that is frustoconically tapered and adapted to axially slide and temporarily engage the upper interior surface at the top of the container.

4. The apparatus of claim 1, wherein the freezing point of the second fluid is in a range of −1° C. to −30° C., the cavity is permanently sealed by a weld or adhesive, and the body is translucent or transparent such that the second fluid is visible from an exterior of the body, and the seal loosely, axially, slidingly, makes direct contact with the upper interior surface of the container at the top of the container.

5. The apparatus of claim 1, wherein the body varies in axial sectional shape, such that an exterior surface of the body undulates substantially throughout an axial length of the container, and the cavity is tapered along a substantially entire axial length thereof.

6. The apparatus of claim 1, wherein the seal also comprises a cap that is threadingly and releasably coupled to the plug, and the plug is unthreaded.

7. The apparatus of claim 1, wherein the seal is located on an axial end of the apparatus, the second fluid has a liquid volume sufficient to fill all of the cavity which is located axially outside of the seal, and extend at least partially into a portion of the body located axially inside the seal, such that said portion of the body is an expansion reservoir when the second fluid is frozen and expands in volume into said portion of the body.

8. An apparatus for maintaining a temperature of wine in a bottle, comprising:

a body having an axis, a proximal end, a distal end, a cavity inside the body that is open on the proximal end, and tapered shape in an axial direction;

the body has a proximal diameter ($d_p$) at the proximal end that defines the greatest diameter of the body, a distal diameter ($d_d$) at the distal end that defines the least diameter of the body, a first intermediate diameter ($d_1$) located axially between the proximal and distal ends that is smaller than $d_p$, and a second intermediate diameter ($d_2$) located axially between $d_1$ and the distal end that is larger than $d_1$, and the body varies in axial sectional shape, such that an exterior surface of the body asymmetrically undulates for the entire axial length thereof;

a fluid located in the cavity and having a freezing point below 0° C.; and a seal assembly mounted to the body to seal the fluid inside the cavity, the seal assembly is adapted to loosely, axially, slidingly, make direct contact with the bottle itself, and temporarily engage and seal an upper interior surface of the bottle at a top of the bottle, and the seal assembly comprises a different material than the body.

9. The apparatus of claim 8, wherein the body and the seal assembly have no apertures through which any fluid flows, and the body varies in axial sectional shape throughout an axial length of the bottle, such that an exterior surface of the body undulates for the substantially entire axial length thereof, and the seal comprises a synthetic stopper.

10. The apparatus of claim 8, wherein the body has only one cavity, the fluid is the only material located inside the body, the body contacts the fluid substantially throughout an axial length of the container, the seal comprises a handle for the apparatus when the body is inside the container, and an interior surface of the cavity is tapered axially for a substantially entire axial length thereof.

11. The apparatus of claim 8, wherein the body is formed from plastic, and the seal assembly comprises a stopper that is frustoconically tapered and adapted to engage and seal the upper interior surface at the top of the bottle.

12. The apparatus of claim 8, wherein the freezing point of the fluid is in a range of −1° C. to −30° C., the cavity is permanently sealed by a weld or adhesive, the body is translucent or transparent such that the fluid is visible from an exterior of the body, and the seal comprises a handle for the apparatus when the body is inside the container, together the body, seal and handle form a unitary structure that has a tapered profile along a substantially entire axial length thereof.

13. The apparatus of claim 8, wherein the seal assembly comprises a plug mounted to the proximal end of the body, a cap assembly threadingly and releasably coupled to the plug, the plug is unthreaded, and together the body, seal assembly, plug and cap assembly form a unitary structure.

14. The apparatus of claim 8, wherein the seal assembly is located on an axial end of the apparatus, the fluid has a liquid volume sufficient to fill all of the cavity which is located axially outside of the seal assembly, and extend at least partially into a portion of the body located axially inside the seal assembly, such that said portion is a fluid expansion reservoir when the fluid is frozen and expands in volume into said portion.

15. An apparatus for a container having a first fluid, comprising:

a body having a cavity and a second fluid sealed inside the cavity, the body and the container are configured to be substantially similar in axial length, and the body is configured to temporarily contact the first fluid inside the container;

a seal mounted to the body, the seal is configured to directly make contact with the container itself, and loosely, slidingly, temporarily engage and axially seal an upper interior surface of the container at a top of the container, the seal has a seal profile that includes a handle that is frustoconical, the handle is configured to remove the apparatus when the body is inside the container, and together the body, seal and handle form a unitary structure that has a tapered profile along an entire axial length thereof;

the body and the seal have no apertures through which the first fluid or the second fluid flows; and the body has a proximal diameter ($d_p$) at the proximal end that defines a maximum diameter of the body, a distal diameter ($d_d$) at the distal end that defines a minimum diameter of the body, a first intermediate diameter ($d_1$) located axially between the proximal and distal ends that is smaller than $d_p$, and a second intermediate diameter ($d_2$) located axially between $d_1$ and the distal end that is larger than $d_1$, and the body varies in axial sectional shape, such that an exterior surface of the body undulates for the entire axial length thereof, wherein the seal comprises a plug mounted to the proximal end of the body, a cap threadingly and releasably coupled to the plug, and together the body, seal, plug and cap form a unitary structure.

16. The apparatus of claim 15, wherein the cavity is permanently sealed by a weld or adhesive, and the seal comprises a synthetic stopper.

17. The apparatus of claim 15, wherein the exterior surface of the body asymmetrically undulates.

* * * * *